US005133098A

United States Patent [19]

Weber

[11] Patent Number: 5,133,098

[45] Date of Patent: * Jul. 28, 1992

[54] INFLATABLE BABY SUPPORT PILLOW

[76] Inventor: Eugene W. Weber, 334 Avila Rd., San Mateo, Calif. 94404

[ * ] Notice: The portion of the term of this patent subsequent to Jul. 9, 2008 has been disclaimed.

[21] Appl. No.: 715,496

[22] Filed: Jun. 14, 1991

Related U.S. Application Data

[63] Continuation-in-part of Ser. No. 64,581, Jun. 22, 1987, Pat. No. 5,029,351.

[51] Int. Cl.[5] ..... A47G 27/08; A47G 9/00

[52] U.S. Cl. ..... 5/655; 5/449; 5/457; 5/900.5; 5/902

[58] Field of Search ..... 5/431, 441, 449, 457, 5/458, 455, 434, 436; D6/596, 601

[56] References Cited

U.S. PATENT DOCUMENTS 5,029,351 7/1991 Weber ..... 5/431

FOREIGN PATENT DOCUMENTS

WO8911264 11/1989 PCT Int'l Appl. ..... 5/431

*Primary Examiner*—Alexander Grosz

[57] ABSTRACT

A baby supporter and positioner that can be used by nursing mothers and any other person who wants to hold and interact with a baby on their lap while seated. The baby support pillow is wedge shaped to provide for a slightly inclined positioning of the baby and to provide for better alignment of the baby's head to the mother's breast. The baby support pillow has at least one contoured side to allow the pillow to cradle the person's body and provide a firm supportive surface close to the person's body for the baby.

15 Claims, 2 Drawing Sheets

INFLATABLE BABY SUPPORT PILLOW

REFERENCE TO RELATED APPLICATION

This application is a continuation in part of application Ser. No. 07/064,581, filed Jun. 22, 1987 now U.S. Pat. No. 5,029,351.

BACKGROUND-FIELD OF INVENTION

This invention relates to support pillows, and specifically to a pillow specially designed to support a baby's head and body while breastfeeding or bottle feeding, and also to be used to support the baby while interacting with it in a variety of other activities. This invention includes variations to the baby support pillow described in my earlier application referenced above.

Heretofore when a mother breast fed her baby she had to cradle the baby in her arms to hold the baby's head at the required height to align with her breast. Holding a baby like this for any length of time puts considerable stress on the mother's body. A common complaint of breastfeeding mothers is lower back pain. A sleeping pillow or furniture pillow could be used to help support the baby's body; however, most pillows of this type have rounded or sloping edges and provide little support where needed. Therefore short of piling many pillows on top of one another it has been difficult to get the proper height and support from one easy-to-handle pillow.

Nursing slings have been designed to hold a baby with the weight of the sling pulling on the mother's neck and upper back. This method puts considerable stress on the mother's neck and back. Reversing the baby to nurse on the other breast can be quite cumbersome and annoying to the baby. A sling type device also tends to pull the baby's head and body toward the mother, which restricts the baby's freedom of movement. A sling type device is not suitable for bottle feeding because of this.

BACKGROUND-DESCRIPTION OF PRIOR ART

Published International application number PCT/DK89/00128 describes a substantially rigid C-shaped pillow. The pillow is constructed by two C-shaped layers of rubber or plastic material being joined together along their edge and provided with a valve for inflation of the pillow. The described pillow does not have the features or the advantages of the present invention as described below.

SUMMARY OF THE INVENTION

Accordingly, several objects and advantages of my invention are: to provide a firm support for a breastfeeding or bottle feeding baby without putting undo strain on the mother's body; and to provide an easily adjustable support that can accommodate many sizes of babies and mothers.

In addition, further objects and advantages of my invention are to provide a one piece easy to handle baby support that can be readily reversed to allow for breastfeeding the baby on either side, and to provide a comfortable support for the baby's body to allow the mother and father or any person to more easily hold the baby while interacting with it in such activities as reading, washing, dressing, rocking to sleep and to simplify administering oral preparations such as prescriptions, vitamins, etc.

It is a related object to provide such a baby support pillow as an inflatable body formed from edge-secured sheets of material. Such an inflatable support pillow requires substantially full inflation to provide the required firmness and stability. This causes a tendency to balloon out at the support surface, and this problem is addressed by this invention.

Further objects and advantages of my invention will become apparent from a consideration of the drawings and ensuing description.

DESCRIPTION OF PREFERRED EMBODIMENTS

Figure 1:
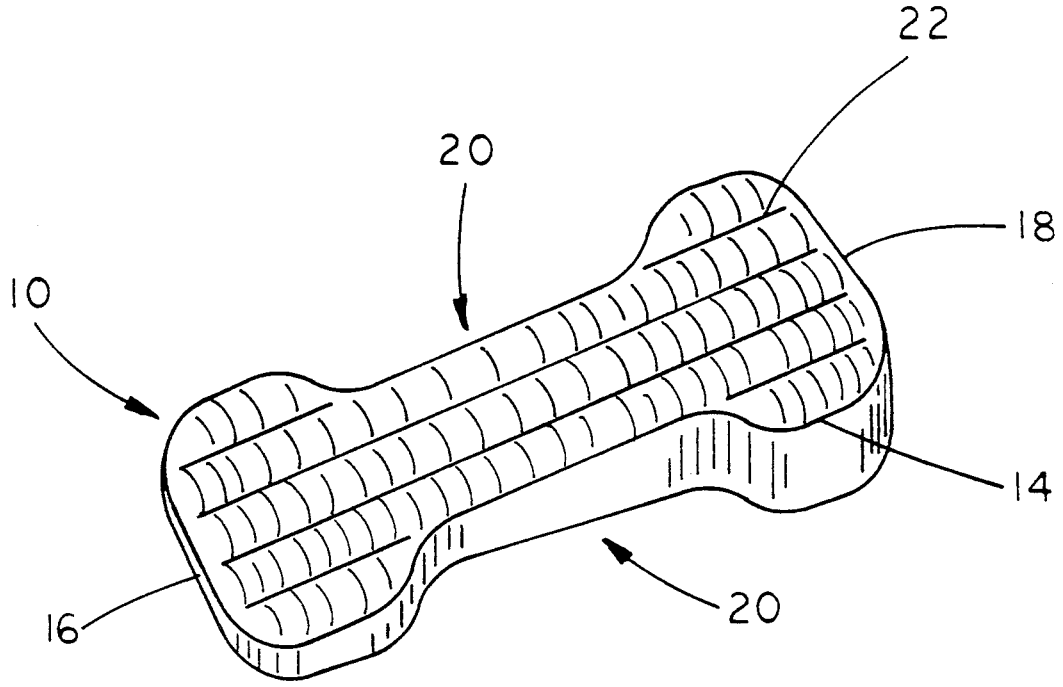
FIG. 1 is a perspective view of my invention showing the contoured sides, squared off edges and wedge shaping of the pillow.

FIG. 1 shows a baby support pillow 10 in accordance with the invention, with its particular shaping characteristics. The pillow preferably is made of a rubber or plastic film material that is joined together along the edges and fitted with a valve 12 for inflation. The material pieces are cut such that the seams 14 for joining the various pieces together define the edges of the pillow at both top and bottom, as shown.

The approximate length of the baby support pillow 10 is 22 inches, and should in any event be between about 18 and 30 inches. The overall width is approximately 10 inches (preferably between about 8 and 15 inches). The thin end 16 of the wedge shaped baby support pillow is approximately 2 inches thick (preferably in the range of 1 to 3 inches) and the thick end 18 is approximately 5 inches thick (preferably in the range of 4 inches to 9 inches). Contoured sides 20 are shaped to fit around the mother's belly.

Figure 2:
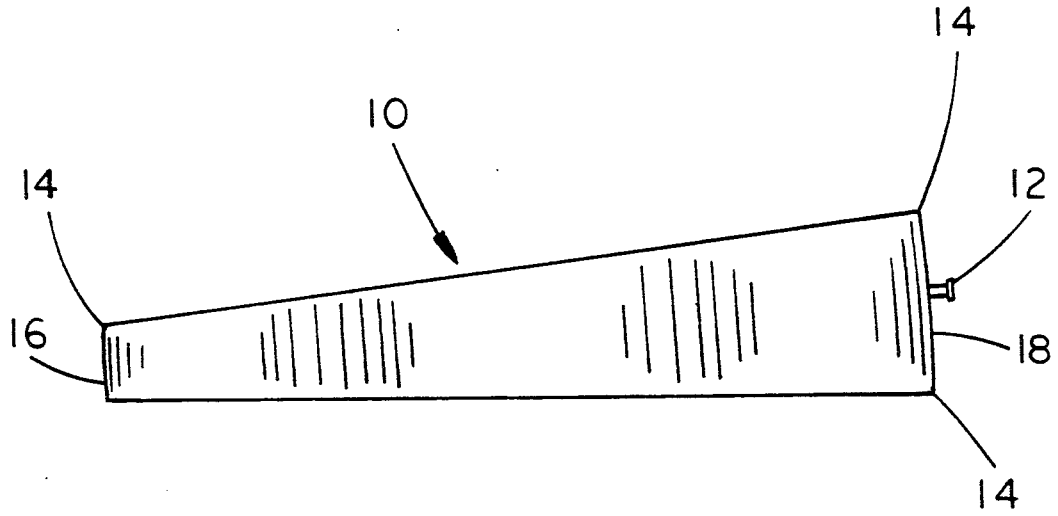
FIG. 2 is a side view of the invention.

As shown in FIGS. 1 and 2, the baby support pillow 10 preferably has substantially squared corners or edges 14, where top and bottom surfaces meet side and end surfaces. This gives better support for the baby. To help maintain the squared edges and flat top and bottom surfaces, internal ties or gussets can be added and attached internally to the top and bottom faces at points or along lines, as indicated for example by attachment lines 22 in FIGS. 1 and 3. FIG. 4 shows in transverse cross section a series of such ties 24, which can be sheets of material secured to the top and bottom sheets of material internally as indicated. These can also serve as internal baffles providing only small open areas for flow of air from chamber 26 to adjacent chamber 26, helping to stabilize the baby-supporting surface as in many air mattresses.

FIG. 2 shows the baby support pillow 10 in side view.

The contoured side 20 as shown in FIG. 1 allows the pillow to cradle around the mother's body, via a contoured cut out 28, and to provide firm support for the baby's head. As contrasted with one or a pile of conventional pillows, the pillow of the invention provides firm support all along its top surface, out to the edges, without tapering or roundness (as generally occurs with inflatable devices formed of sheet material). In the preferred embodiment, the top and bottom surfaces of the baby support pillow 10 are generally planar. However, variations can be made wherein some contouring is provided in these surfaces for receiving a baby. Even if such top/bottom contouring is provided, it is still preferred that the edges or corners, where these surfaces meet side and end surfaces, be relatively squared and abrupt for baby support out to the edges, with no tendency for the baby to roll off.

Figure 3:
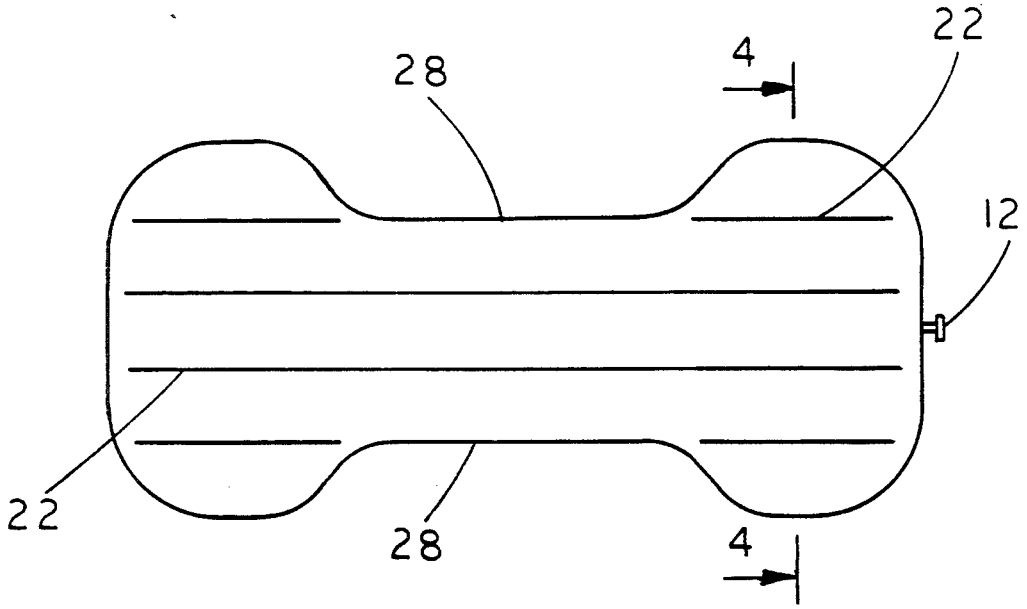
FIG. 3 is a top view of the invention.
Figure 4:
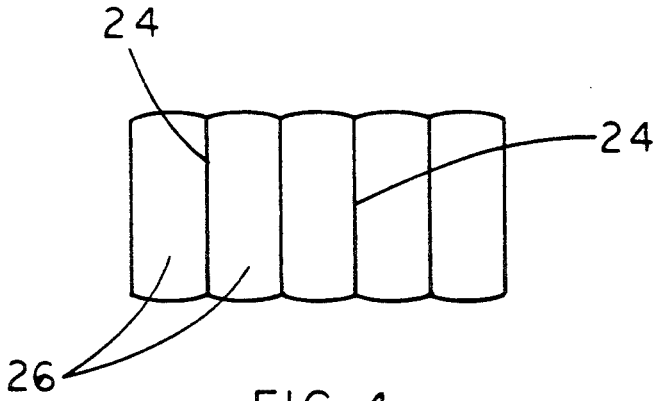
FIG. 4 is a transverse cross section view as seen along the line 4—4 in FIG. 3.

The contoured cut out 28 of the contoured side 20, as seen in FIG. 3, is preferably large enough to allow for some longitudinal (side to side with respect to the mother) movement of the pillow. The cut out may be about 2 inches in depth and in the range of about 6 inches to 18 inches in length, preferably about 9 to 12 inches. By moving the baby support pillow 10 in the longitudinal direction the wedge feature allows for a height adjustment of the baby's head to better align with the mother's breast. The wedge feature is also important in that it elevates the baby's head while eating. This can help to reduce the incidence of ear infections caused by feeding a baby while in the horizontal position.

By simply lifting the baby, and rotating the baby support pillow 180 degrees, the baby can be easily repositioned to nurse on the other breast.

The baby support pillow can also be set beside the mother to allow for breastfeeding the baby in what is commonly called the "football hold" position. This position is especially useful for a mother with sensitive nipples; this often occurs when she starts nursing her newborn baby.

The baby support pillow 10 can also be used to more comfortably hold the baby reclining on its back, on a seated person's lap. This positioning of the baby support pillow can be useful for bottle feeding, talking to, washing, dressing and many other interactive functions that people want to do with a baby.

Thus it can be seen that the baby support pillow provides a supportive, easy to use baby positioner that can be easily used for many purposes and by persons of almost any age. The device can be used for bottle feeding as well as breast feeding, and it can be used for changing the baby or otherwise interacting with the baby. Used regularly in the breastfeeding mode it can greatly reduce the stress and fatigue on the mother's body.

Figure 5:
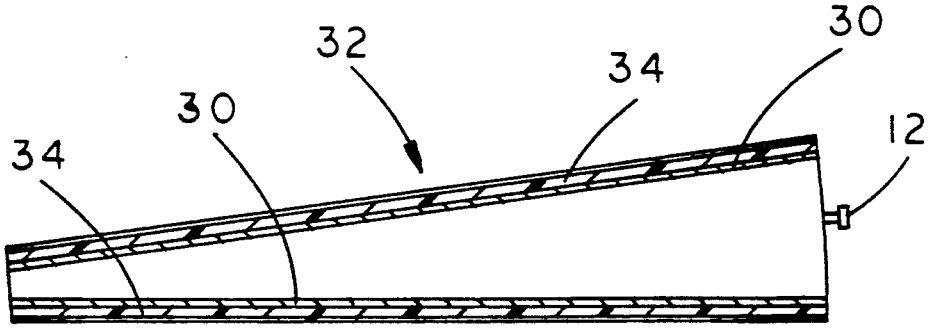
FIG. 5 is a longitudinal cross section view showing another embodiment of the invention for achieving the desired pillow shape.

Also, another method and structure for maintaining the preferably flat top and bottom surfaces and squared corners or edges would be to incorporate a non-flexible material on the top and bottom faces. As shown in FIG. 5, a thin sheet 30 of pressed board, rigid plastic or cardboard, for instance, could be laminated to the top and bottom faces of the inflatable bag 32 to help maintain flatness. A layer of foam 34 can be positioned between the rigid sheet 30 and the bag's inner surface at the baby support side and preferably also at the bottom side, for comfort. Additionally, the layer of foam 34 and the rigid sheet 30 could also be laminated to the outer faces of the inflatable bag 32.

It should be understood that the dimensions suggested above can be varied to provide for say a small, medium and large size of this invention. Furthermore the materials suggested could be varied. Additionally, an outer cloth could be added.

While my above description contains many specifications these should not be construed as limitations on the scope of the invention, but rather as an exemplification of one preferred embodiment thereof. Many other variations are possible.

Accordingly, the scope of the invention should be determined not by the embodiments illustrated, but by the appended claims and their legal equivalents.

I claim:

1. A baby support device to be used by a seated person, comprising:

an elongated body of sufficient size to support a baby when put between the baby and the seated person's legs, said elongated body having a length substantially greater than its lateral width for supporting the baby's body length, said elongated body having top and bottom surfaces similarly shaped but non-parallel such that the elongated body is wedge shaped in a gentle slope in the longitudinal direction, so that the baby's head is elevated when the baby lies on the support device, said elongated body having two elongated sides, generally perpendicular to the top and bottom surfaces, at least one of the elongated sides having a contoured cut out positioned and sized to permit the device to partially wrap around and nest against the seated person's body, and said elongated body being made of sheet rubber or plastic material being joined and sealed together along edges and provided with a valve for inflation of the baby support device.

2. The baby support device of claim 1, wherein the contoured cut out has curving surfaces for engagement against the seated person.

3. The baby support device of claim 1, including a thick end and a thin end on said wedge shaped elongated body, with the thick end of the wedge of sufficient height to allow for easy alignment of a reclining baby's mouth with a seated mother's breast for nursing.

4. The baby support device of claim 1, including said contoured cut outs on both elongated sides, whereby the device can be rotated 180 degrees to orient the gentle slope in either direction with respect to the seated person, whereby the seated person can comfortably nurse the baby on either breast.

5. The baby support device of claim 4, wherein the thick end has a thickness of about 4 inches to 9 inches.

6. The baby support device of claim 4, wherein the thin end has a thickness of about 1 inch to 4 inches.

7. The baby support device of claim 1, including a thick end and a thin end on said wedge shaped elongated body, with the thick end of the wedge of sufficient height to elevate the baby's head above its feet to better position and support the baby on a seated person's lap during bottle feeding.

8. The baby support device of claim 7, wherein the thick end has a thickness of about 5 inches.

9. The baby support device of claim 8, wherein the thin end has a thickness of about 2 inches.

10. The baby support device of claim 1, including means for maintaining the top and bottom surfaces of the device generally planar, with generally squared edges where the top and bottom surfaces meet side and end surfaces, whereby a baby is well supported out to the edges of the surface on which it rests, without tendency to roll off.

11. The baby support device of claim 1, wherein the elongated body includes a removable cover.

12. The baby support device of claim 11, wherein the elongated body has an overall width between about 8 and 15 inches.

13. The baby support device of claim 12, wherein the contoured cut out has a length of about 10 inches.

14. The baby support device of claim 1, wherein the length of the elongated body is between about 18 and 30 inches.

15. The baby support device of claim 14, wherein the contoured cut out has a depth of about 2 inches.

* * * * *